United States Patent [19]

Gordin et al.

[11] Patent Number: 5,075,828

[45] **Date of Patent: * Dec. 24, 1991**

[54] GLARE CONTROL LAMP AND REFLECTOR ASSEMBLY AND METHOD FOR GLARE CONTROL

[75] Inventors: Myron K. Gordin; Jim L. Drost, both of Oskaloosa, Iowa

[73] Assignee: Musco Corporation, Oskaloosa, Iowa

[ * ] Notice: The portion of the term of this patent subsequent to Feb. 16, 2005 has been disclaimed.

[21] Appl. No.: 535,834

[22] Filed: Jun. 11, 1990

Related U.S. Application Data

[63] Continuation of Ser. No. 308,750, Feb. 10, 1989, Pat. No. 4,947,303, which is a continuation-in-part of Ser. No. 44,335, Apr. 30, 1987, Pat. No. 4,816,974, which is a continuation-in-part of Ser. No. 865,086, May 19, 1986, abandoned, which is a continuation-in-part of Ser. No. 687,864, Dec. 31, 1984, abandoned.

[51] Int. Cl.[5] ..... F21V 7/00

[52] U.S. Cl. ..... 362/297; 362/346; 362/277; 362/256; 313/114

[58] Field of Search ..... 362/296, 297, 298, 301-307, 362/341, 346, 347, 359, 255, 256, 431, 319, 277, 282, 343, 247, 248; 313/113, 114, 117

[56] References Cited

U.S. PATENT DOCUMENTS

| | | | |
|---|---|---|---|
| 1,166,244 | 12/1915 | Norton | 362/347 |
| 1,249,133 | 12/1917 | Lebby | 362/303 |
| 1,397,803 | 11/1921 | Ensor et al. | 362/305 |
| 1,466,354 | 8/1923 | Drury | 362/298 |
| 1,560,408 | 11/1925 | Charlebois | 362/343 |
| 1,610,105 | 12/1926 | Moise | 362/298 |
| 1,639,753 | 8/1927 | Shelton | 362/282 |
| 1,660,067 | 2/1928 | Burtis | 362/298 |
| 1,691,209 | 11/1928 | Reynolds et al. | 362/255 |
| 1,751,111 | 3/1930 | Steele et al. | 362/343 |
| 1,867,138 | 7/1932 | Christmas | 362/298 |
| 1,926,675 | 9/1933 | Grunwald | 362/256 |
| 1,928,665 | 10/1933 | Irber | 362/256 |
| 1,990,666 | 2/1935 | O'Loughlin | 362/256 |
| 1,998,967 | 4/1935 | Raynolds | 313/113 |
| 2,018,155 | 10/1935 | Shanahan | 362/256 |
| 2,221,629 | 11/1940 | Birdseye | 362/297 |
| 2,277,563 | 3/1942 | Scott et al. | 362/309 |
| 2,440,832 | 5/1948 | Pennybacker | 313/113 |
| 2,578,451 | 12/1951 | Rex | 362/297 |
| 2,826,710 | 3/1958 | Lipscomb | 313/113 |

(List continued on next page.)

FOREIGN PATENT DOCUMENTS

| | | | |
|---|---|---|---|
| 210185 | 1/1956 | Australia | 362/297 |

*Primary Examiner*—Ira S. Lazarus
*Assistant Examiner*—D. M. Cox
*Attorney, Agent, or Firm*—Zarley, McKee, Thomte, Voorhees, & Sease

[57] ABSTRACT

A glare control lamp and reflector assembly and method for glare control which includes a conventional lamp and symmetrical reflector for providing a controlled light beam to a target area. A reflector shield can be positioned on the reflector below the lamp and has the properties of diverging incident light downwardly towards the target area and thus controls reflection upwardly which would produce glare. A glare shield can be positioned on the top of the reflector and extends outwardly from the outer edge of the reflector to block both direct light and reflected light from traveling upwardly and outwardly which would produce glare. In a further combination, a lamp shield can be positioned over a portion of the outermost extending end of the lamp to prevent unreflected light from directly causing glare. The method for controlling glare includes the steps of providing a conventional lamp and reflector assembly, positioning a reflector shield in the bottom of the reflector beneath the bulb to coverge instant light downwardly to the target area, and providing a glare shield extending around and outwardly from the top of the reflector to block and divert incident light downwardly towards the target area. An additional step would be to provide a lamp shield over the outwardmost end of the lamp to block directly emanating light from causing glare.

20 Claims, 9 Drawing Sheets

U.S. PATENT DOCUMENTS

| | | | |
|---|---|---|---|
| 3,210,536 | 10/1965 | Elmer | 362/297 |
| 3,281,620 | 10/1966 | Miller | 313/113 |
| 3,511,985 | 5/1970 | Muscovitch | 362/282 |
| 3,536,946 | 10/1970 | Kapelman et al. | 313/113 |
| 4,261,029 | 4/1981 | Mousse | 362/297 |
| 4,338,655 | 7/1982 | Gulliksen et al. | 362/281 |
| 4,341,975 | 7/1982 | Phillipp et al. | 313/25 |
| 4,351,018 | 9/1982 | Fratty | 362/215 |
| 4,423,471 | 12/1983 | Gordin et al. | 362/307 |
| 4,462,067 | 7/1984 | Altman | 362/268 |
| 4,506,315 | 3/1985 | Maekawa et al. | 362/308 |
| 4,598,348 | 7/1986 | Richter | 362/390 |
| 4,725,934 | 2/1988 | Gordin | 362/298 |
| 4,816,974 | 3/1989 | Gordin | 362/346 |
| 4,947,303 | 8/1990 | Gordin | 362/261 |

GLARE CONTROL LAMP AND REFLECTOR ASSEMBLY AND METHOD FOR GLARE CONTROL

This is a continuation of Ser. No. 07/308,750, Feb. 10, 1989, now U.S. Pat. No. 4,947,303, which is a continuation-in-part of Ser. No. 07/044,335, Apr. 30, 1987, now U.S. Pat. No. 4,816,974, which is a continuation-in-part of Ser. No. 07/865,086, May 19, 1986, abandoned, which is a continuation of Ser. No. 07/687,864, Dec. 31, 1984, abandoned.

BACKGROUND OF THE INVENTION

1. Field of Invention

This invention relates to glare control for lighting fixtures, more particularly to a means and method for controlling glare in reflector lighting units.

2. Description of Problems in the Art

In many lighting applications, there is a need for the combination of a controlled beam, with a significant amount of intensity, provided as efficiently as possible. In such applications, the conventional lamp and symmetrical reflector light fixture is the usual selection for equipment.

There are many different types of lamps and symmetrical reflectors which can be used for these applications, but a typical and detrimental problem with such lights is the glare that they produce. The higher in intensity or the more powerful the light, the higher the potential for glare.

The magnitude of the glare problem can be illustrated by specific examples. In outdoor sports lighting, the combination of the high intensity needed and the height of the suspension of the light fixtures for playability creates glare problems not only for nearby houses and businesses, but also for persons substantial distances away. Although the level of light received at those locations is nominal, the perceived intensity caused by glare creates a bothersome nuisance to those affected. Its seriousness can include creating momentary blindness if directly looked at, which can cause serious problems with oncoming traffic which may be affected by the glare.

Another example involves use of lighting on television or movie sets or the like, wherein the glare is detrimental at various camera angles for recording a scene on film.

Glare can be a problem even with the direct participants and spectators themselves, including both outdoor and indoor sports lighting, if the participant or spectator is positioned at a place which the glare directly affects, thereby affecting sight and visibility.

Thus, there is a real need in the art for means or methods of controlling glare. There are presently some attempts to provide glare control for general lighting fixtures, but no successful method is known for high intensity, controlled beam, wide area lighting units.

It is therefore an object of this invention to provide a means and method for glare control for lamp and reflector assembly lighting units which improves upon the deficiencies or solves some of the problems in the art.

It is a further object of this invention to provide a means and method for glare control for lamp and reflector assembly lighting units which controls glare generated by the lamp and reflector of a lamp and reflector assembly lighting unit.

A further object of this invention is to provide a reflector assembly which controls glare from a lamp and reflector lighting unit.

Another object of this invention is to provide a lamp shield which controls glare directly from the lamp of a lamp and reflector lighting unit.

A further object of this invention is to provide a means and method for controlling glare of a lamp and reflector lighting unit which is adjustable for each glare problem.

Another object of this invention is to provide a means and method for controlling glare of a lamp and reflector lighting unit which achieves glare control with a minimum reduction in the amount of light intensity reaching the target area.

Another object of the invention is to provide a means and method for controlling glare of a lamp and reflector lighting unit which utilizes maximum gathered and reflected light to present to the target area.

A further object of this invention is to provide a means and method for controlling glare of a lamp and reflector lighting unit which is adjustable in design, economical, and durable.

Another object of this invention is to provide a means and method for controlling glare of a lamp and reflector lighting unit which can be retrofitted to existing lamp and reflector lighting units.

These and other features, objects and advantages of the invention will become apparent to those skilled in the art with reference to the accompanying specification.

SUMMARY OF THE INVENTION

This invention utilizes a specialized reflector assembly in a lamp and reflector lighting unit to control glare from the lighting unit. A conventional lighting unit generally consists of a lamp socket or bulb cone, a lamp operatively mounted therein, and a symmetrical reflector in association with the lamp to provide a controlled light beam from the light of the lamp to a target area.

One means and method for controlling glare according to the invention consists of a reflector assembly comprised of the conventional symmetrical reflector, a reflector shield and a glare shield.

The reflector shield comprises a piece of reflective material which is mounted or positioned beneath the lamp on the bottom half of the interior surface of the conventional converging symmetrical reflector. The reflector shield is in effect a diverging reflector in that it diverts all incident light upon it downwardly towards the target area and thereby prevents incident light, whether direct or reflected, from projecting inwardly and outwardly and therefore producing glare.

The reflector shield can cover up to approximately the entire bottom half of the interior of the reflector, or can cover an angular section thereof depending on requirements.

A glare shield is mounted or positioned around the peripheral edge of the reflector, usually the upper one-half or more of the reflector. The glare shield extends outwardly from the peripheral edge of the reflector and serve to block light, whether direct or reflected from the lamp, from traveling upwardly and outwardly and causing glare. Additionally, the glare shield diverts substantial incident light downwardly towards the target area.

An additional embodiment of the invention involves utilization of a lamp shield to further reduce and control glare. The lamp shield is mounted or positioned over the upper part of the outwardmost end of the lamp to prevent and block directly emanating light, which can cause glare. The major purpose of the lamp shield is to force as much as possible, the light emanating from the lamp to be reflected from either the reflector or the reflector shield. The lower part of the end of the lamp is left uncovered because the directly emanating light would mostly be directed to the target area.

A still further feature and embodiment of the invention includes an arc shield which is positioned on or closely adjacent to the arc of the arc lamp used with the invention. By selective positioning and size of the arc shield, light can be blocked and/or redirected from a very close distance to the arc in a very efficient, accurate and non-wasteful manner. The arc shield can be comprised of a separate piece secured to the arc tube. It can also take other forms such as an opaque and/or reflective coating inside or outside the arc tube. The arc shield can be used independently or in combination with any of the other glare and spill light controlling elements of the invention such as reflector shields, glare shields, and lamp shields.

The method of controlling glare includes the steps of providing the conventional lamp and reflector lighting unit with a glare shield, reflector shield, lamp shield, or arc shield, or any combination thereof, depending upon the nature of the glare which is required to be controlled. This includes retrofitting existing lighting units to control glare.

DETAILED DESCRIPTION OF THE PREFERRED EMBODIMENT

Figure 1:
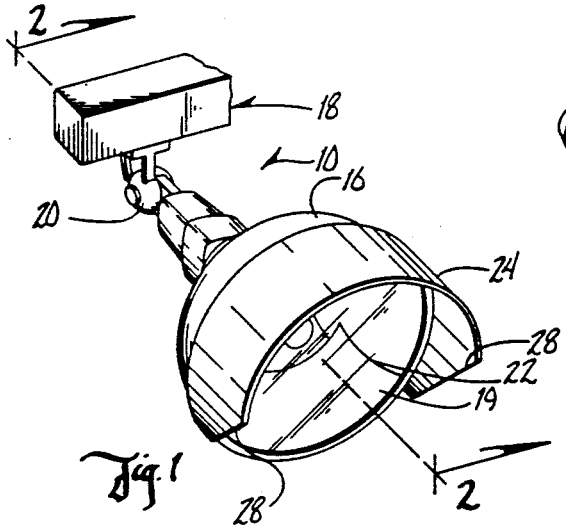
FIG. 1 is a perspective view of one embodiment of the glare control assembly.

In reference to the drawings, and in particular FIG. 1, there is shown a glare control lamp and reflector assembly 10 in accordance with the invention. The assembly consists first of a lamp 12 operatively connected and secured to a lamp socket bulb cone 14. A conventional symmetrical reflector 16 surrounds lamp 12 to provide a controlled beam of light. Symmetrical reflector 16 surrounds lamp 12 to provide a controlled beam of light. Symmetrical reflector 16 is a converging reflector in both its upper and lower hemispheres, meaning that reflector 16 causes the light reflected from it to emanate in a converging manner.

As is conventional, bulb cone 14 is adjustably mounted to a support 18 by a vertically and horizontally adjustable connecting elbow 20. Likewise, conventionally, a transparent cover 19 is placed over lamp 12 and reflector 16.

A reflector shield 22 is mounted on the lower surface of reflector 16, beneath lamp 12. Reflector shield 22 is of such configuration that it forms a diverging reflecting surface thus transmitting incident light divergingly downward.

A glare shield 24 is mounted parametrically around the circumferential perimeter of the upper portion of reflector 16 and extends outwardly therefrom. Glare shield 24 blocks light emanating directly out of lamp 12 and reflecting off of reflector 16 from traveling upwardly and outwardly and thus reduces glare. Glare shield 24 also prevents waste of dissipated upward light and concentrates the light where it is needed, on the target area.

The combination of reflector shield 22 and glare shield 24 serves to control direct and reflected light from lamp 12 and reflector 16 to minimize light being directed away from the target area, and more particularly, to prevent light from traveling upwardly and outwardly, which produces the most glare.

Figure 2:
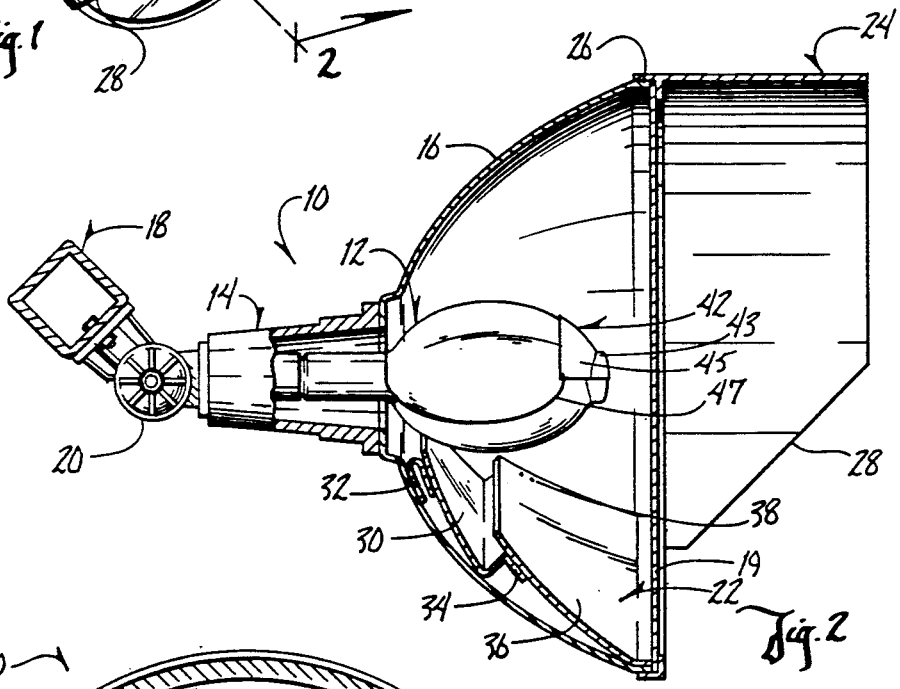
FIG. 2 is a sectional view taken along line 2—2 of FIG. 1.

By referring to FIG. 2, the exact structure of this embodiment of invention 10 can be more clearly seen. Glare shield 24 can extend around the upper hemisphere of reflector 16. Exactly how far glare shield 24 extends depends on the glare control needed, therefore, it can extend less than or greater than 180° of its circumference according to choice and needs. Lip 26 is mateable around the exterior of reflector 16 allowing secure mounting of glare shield 24 with no gaps. Beveled edges 28 of glare shield 24 further prevent glare from the sides of invention 10, and yet allows maximum light to reach the target area.

FIG. 2 shows a first embodiment of reflector shield 22. Because of the close distance between reflector shield 22 and lamp 12, a very shallow reflection angle is formed between the two, especially at the end of reflector shield 22 nearest lamp 12. Therefore, it has been found that a two-part stepped reflector shield 22 can be effectively used. An inner section 30 is mounted by U-shaped bracket 32 to the interior of reflector 16 to the required reflection orientation to lamp 12. Inner section 30 has an inverted L-shaped outer edge 34, which in turn supports outer section 36 of reflector shield 22. The size of L-shaped outer edge 34 is such that it holds outer section 36, which is attached at its outer edge to the interior outer edge of reflector 16, at such an orientation as to achieve the proper reflection angle with respect to lamp 12.

Figure 3:
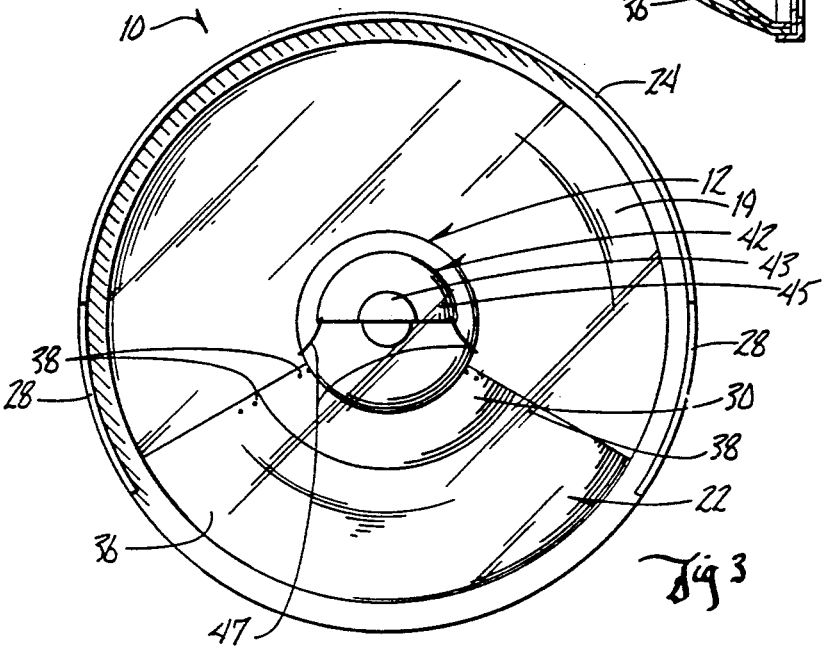
FIG. 3 is a front elevational view of the embodiment of FIG. 2.

The function of reflector shield 22 is to control glare by diverging incident light downwardly towards the target area, instead of allowing reflected light from the bottom of the symmetrical converging reflector to be directed upwardly and outwardly, a prime cause of glare. FIG. 3 shows a front elevational view of the two section reflection shield 22 of FIG. 2. By nature of the size, configuration, and glare controlling properties of glare shield 24, it is preferred that reflector shield 22 occupy an angular section of 180° or less of the interior of reflector 16. In the embodiments shown in the drawings, the angular section is approximately 120°. Angular sections of less than 180° are desired to maximize the amount of gathered and reflected light from lamp 12. Inner and outer sections 30 and 36 of reflector shield 22 can be attached to one another and to reflector 16 by means of rivets 38 or can be otherwise attached or spun into one continuous shape.

It is to be noted that reflector shield 22 can be made of any material which has good reflective qualities and which can withstand the heat produced by high intensity lamps. Aluminum is a preferred material.

Figure 6:
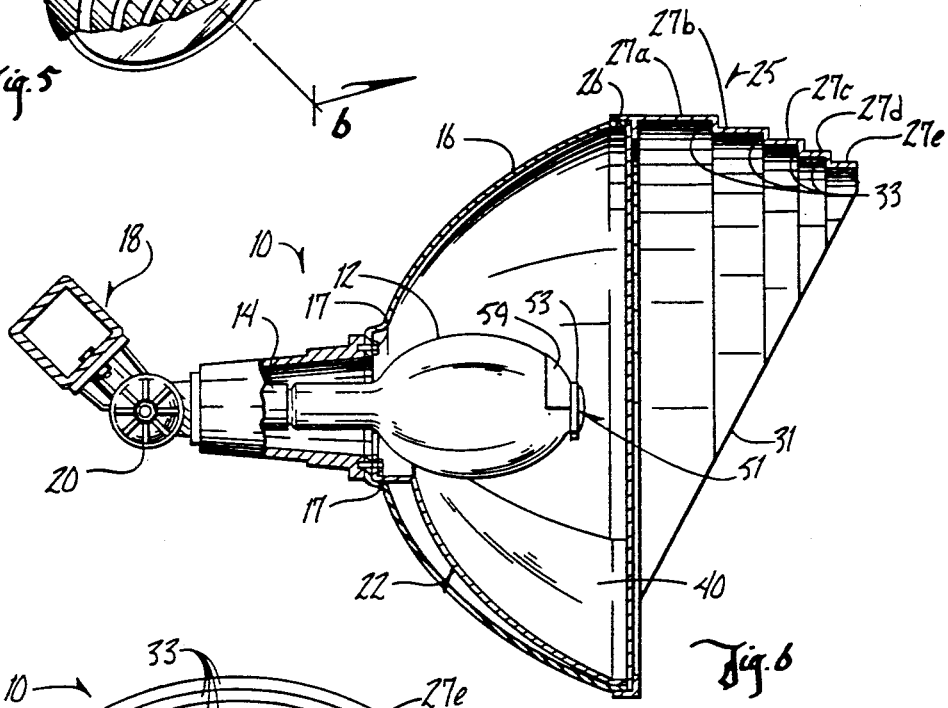
FIG. 6 is a sectional view taken along lines 6—6 of FIG. 5 showing alternative embodiments of the glare shield, reflector shield, and lamp shield.
Figure 7:
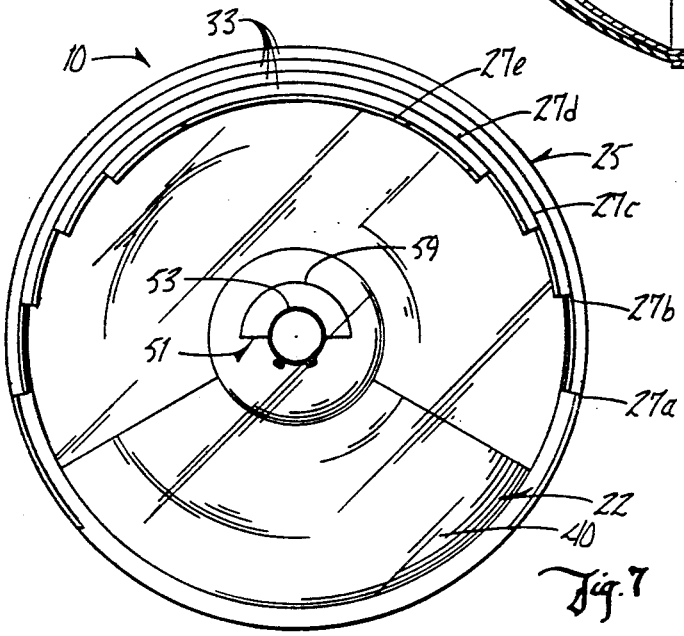
FIG. 7 is a front elevational view of the assembly of FIG. 6.

A second embodiment of reflector shield 22 is depicted in FIGS. 6 and 7. Instead of a two-piece configuration, reflector shield 22 could be constructed from a one-piece member 40, which is mounted to, and held in the correct reflective orientation with respect to lamp 12 by U-shaped bracket 32, and any mounting means known in the art. Alternatively, it could be attached to the base of reflector 16 by the very bolts or screws 17 used to attach reflector 16 to bulb cone 14, as seen in FIG. 3.

Figure 5:
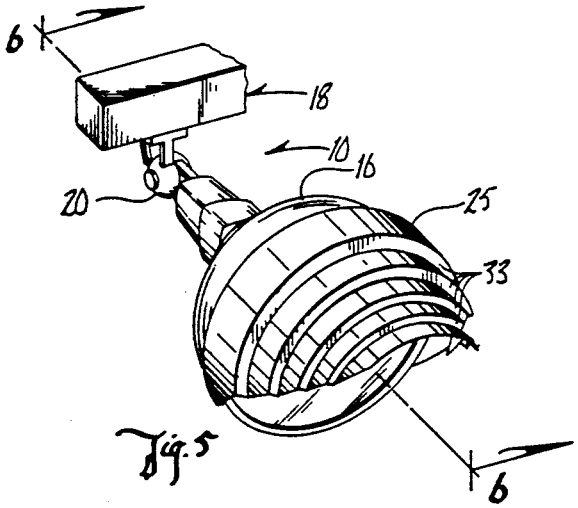
FIG. 5 is a perspective view of another embodiment of the glare control assembly.

FIGS. 5, 6 and 7 also show an alternative embodiment of the glare shield, here referred to as stepped glare shield 25. Stepped glare shield 25 is the preferred embodiment because it causes more light to be redirected to the target area and allows the lamp shield to be smaller, as is discussed below, thus further allowing more light to reach the target area. By referring to FIGS. 5 and 7, it can be seen that stepped glare shield 25 has an angled edge 31 along its side which determines the glare cut-off point. Each step in the glare shield referenced by numerals 27*a–e* has a decreasing diameter and is attached to the preceding step by brackets 29. Each step 27*a–e* is a flat curved piece and can be of varying widths. A corresponding curved vertical piece 33 is secured between adjacent steps 27*a–e*. Alternatively, stepped glare shield could be manufactured as one piece.

Figure 4:
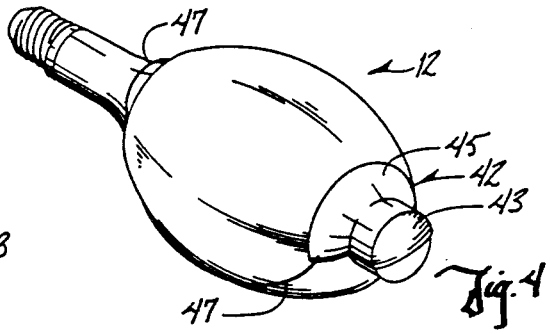
FIG. 4 is a perspective view of a lamp with one embodiment of a lamp shield mounted thereon.

The drawings also depict embodiments of an additional feature of the invention which can be employed to further control glare. A first embodiment of a lamp shield is shown in FIGS. 2, 3 and 4 by reference numeral 42. A second embodiment is referred to by numeral 51 in FIGS. 6, 7, and 8.

A lamp shield can be placed either directly upon or in association with the outer end of lamp 12. By covering the upper part of the outer end of lamp 12, as shown, directly emanating light from that part of lamp 12 is blocked and reflected forcing the light to be directed to the reflecting surfaces of the assembly 10. This blockage of directly emanating light from the end of lamp 12 further enhances glare control.

Lamp shield 42 is shown on lamp 12 in FIG. 4 and in operation in FIGS. 2 and 3. A nose piece 43 covers and encloses the upper part of the nose end of lamp 12. A fan shaped, curved portion 45 extends rearwardly of nose piece 43 and covers an angular section of the front top of lamp 12. A wire 47 is attached at opposite lateral sides of portion 45 and extends around the back of the upper side of lamp 12 to support and keep lamp shield 42 in place.

Figure 8:
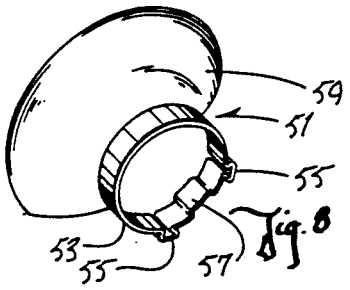
FIG. 8 is a perspective view of an alternative embodiment of the lamp shield.

Lamp shield 51 of FIGS. 7 and 8 utilizes a full band 53 to secure it to lamp 12. Bent portions 55 and 57 provide retentive spring action to band 53. Portion 59 is similar to portion 45 of lamp shield 42. Other methods for retaining the lamp shield to lamp 12, such as are known in the art, could also be used.

It is to be understood that lamp shield 42 or 51 covers an angular section of the outer end of lamp 12, generally between 120° and 180° of the upper part of the upper end of lamp 12. The lamp shields 42 and 51 shown in the drawings cover approximately 180° of the end of lamp 12. The exact angular section covered by the lamp shield is determined by the amount and kind of glare control needed and coordinated with the size and coverage of the glare shield. It is generally between 180° and 120° but could be an even smaller section, depending on the glare shield used. The lamp shield is made of a material that is reflective, and which can withstand high temperature, such as aluminum. The major purpose of lamp shields 42 and 51 is to block and redirect light emanating directly from the end of lamp 12 which would project upwardly and outwardly from invention 10 without being reflected by glare shield 24, and at the same time to present direct out-of-sight glare. Therefore, depending upon the nature of the glare problems, lamp shield 42 can be tailored to a desired configuration. .

In certain rare instances, or on an emergency, temporary basis, the lamp shield can be made to cover the entire outer end of lamp 12 by simply painting the end with a high temperature black or reflective paint, such as is commercially available. The entire end must be painted because the exact final orientation of lamp 12 in bulb cone 14 is not known as lamp 12 is screwed into place.

In operation, the invention 10 functions as follows. Depending upon the nature of the glare problem, a reflector shield 22, glare shield 24 (or 25), or lamp shield 42 (or 51) can be used as desired. Used individually, each would control a portion of glare emanating from lamp 12 and reflector 16. Glare shield 24 (or 25) would block and redirect any light angling extremely upwardly and outwardly from lamp 12 and reflector 16, and thereby reduce glare in that manner. Reflector shield 22 would direct any light incident upon it divergingly downward and thus reduce reflected light leaving reflector 16 upwardly and outwardly, thus reducing glare. Lamp shield 42 (or 51) would block and redirect light emanating directly upwardly and outwardly, thereby reducing glare.

Combining any of the reflector shield 22, glare shield 24 (or 25), and lamp shield 42 (or 51) would further control glare. Glare shield 24 (or 25), in cooperation with either reflector shield 22 or lamp shield 42 (or 51), or both, would serve to additionally prevent light from escaping lamp 12 and reflector 16 upwardly and outwardly.

It will be appreciated that the present invention can take many forms and embodiments. The true essence and spirit of this invention are defined in the appended claims, and it is not intended that the embodiment of the invention presented herein should limit the scope thereof. For example, the exact manner of attachment and configuration of glare shield 24, reflector shield 22, and lamp shield 24 can vary within the scope of the invention.

It is also to be understood that a major advantage of the invention is that the addition of any of reflector shield, glare shield, or lamp shield, can be accomplished either in original manufacturing of the invention 10, or by retrofitting it to existing lamp, lamp socket, and reflector assemblies. Many glare problems exist with recently operating conventional lighting units. After determining the nature of the glare problem, it can be controlled by utilizing the present invention. Reflector glare and/or lamp shields can be retrofitted to the existing lamp and reflector, or a new lamp or reflector can be utilized with any of those elements installed.

It may occur that an existing reflector may not reflect light convergingly in both upper and lower hemispheres. It is to be understood that the invention requires only that a predetermined angular section (usually less than 180° , and preferred to be around 120°) in the lower hemisphere of the reflector cause diverging reflection; and that the remaining portion of the reflector cause converging reflection. Thus, if the reflector is diverging in its upper hemisphere, a retrofit converging reflector shield can be installed. Conversely, if the lower hemisphere is originally diverging, a diverging reflector shield may not be needed. To avoid extensive modification, the reflector can simply be replaced with one capable of easy modification in accordance with the invention.

Figure 9:
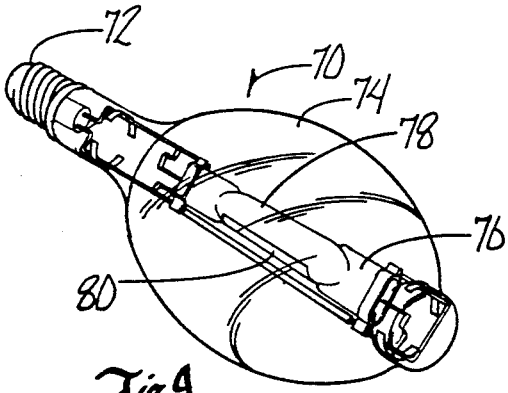
FIG. 9 is a perspective view of an arc lamp including an arc shield according to an alternative embodiment and feature of the invention.

FIGS. 9 through 24 depict a still further feature and alternative embodiment for the invention. By referring specifically to FIGS. 9–11, it can be seen that an arc lamp 70 such as can be used in the lighting units shown in FIGS. 1–8, consists of a screw-in connector 72, a transparent glass bulb 74 which encloses an arc tube 76. The lighting arc is positioned in an enlarged portion 78 of arc tube 76 generally in the middle of bulb 74.

Figure 10A:
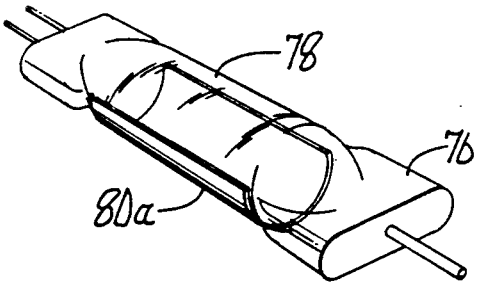
FIG. 10A is an isolated perspective view of the arc tube of FIG. 9 with the arc shield attached.
Figure 11:
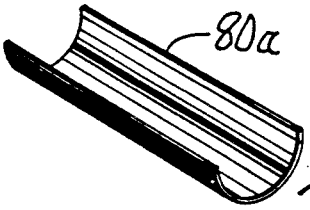
FIG. 11 is an isolated perspective view of the arc shield of FIGS. 9 and 10A.
Figure 10B:
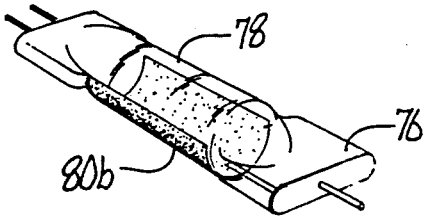
FIG. 10B is an alternative embodiment of the arc tube of FIG. 9 having the arc shield made from a coating of material.

An arc shield 80 is positioned on or directly adjacent to enlarged portion 78 of arc tube 76 to block and/or redirect light emanating from the arc created by arc lamp 70. As shown in FIGS. 10A and 11, arc shield 80A can be a separate piece of material which is secured to arc tube 76. As an alternative, and as shown in FIG. 10B, arc shield 80B could be a coating of material applied to the arc tube 76. It is to be understood that arc shield 80 can be made of a number of different materials, can be applied directly to arc tube 76 on the outside or inside, and can have any number of reflective properties.

By being able to control and redirect light very close to the arc itself, accuracy of placement and direction of the light is enhanced, and loss of light is decreased.

Figure 12:
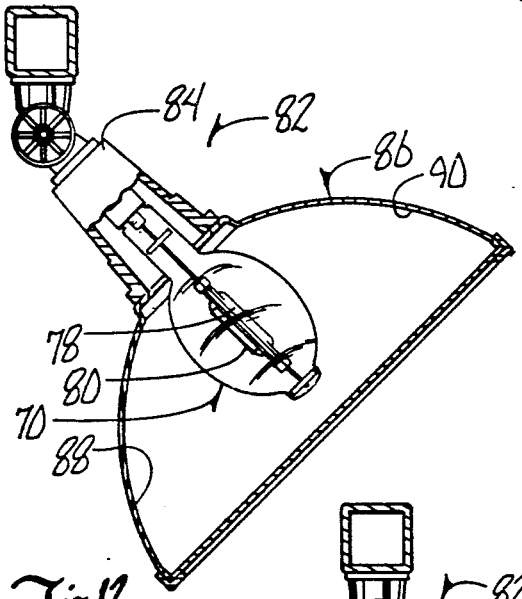
FIG. 12 is a cross-sectional elevational view of the arc lamp of FIG. 9 operatively connected to a lighting fixture including a symmetrical reflector.
Figure 13:
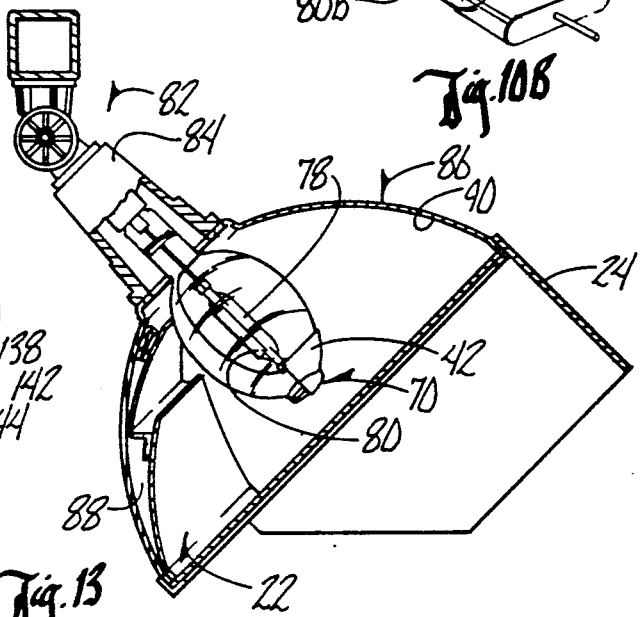
FIG. 13 is a similar view to that of FIG. 12 additionally including a glare shield, a reflector shield, and a lamp shield.

FIGS. 12 and 13 show how arc shield 80 can be used with arc lamp 70 being operatively connected to a lighting fixture 82 having mounting socket or bulb cone 84 and reflector 86. Arc shield 80 would block light from arc lamp 70 from emanating to the lower hemisphere reflecting surface 88 of reflector 86, and redirect it to upper hemisphere reflecting surface 98. Essentially, all the light could therefore be convergingly reflected from upper hemisphere 90 downwardly to a target are. Such a configuration would eliminate upward reflection from lower hemisphere 88 away from the target area, and control or eliminate glare.

Arc shield 80 could therefore produce the same light controlling capabilities of reflector shield 22 of FIGS. 2 and 3 in a simpler and more accurate manner.

FIG. 13 shows how arc shield 80 could be used in selective combination with reflector shield 22, glare shield 24, and/or lamp shield 42. Shields 22, 24, and 42 would operate as previously described. Use of arc shield 80 would allow immediate and more accurate control of the light from arc lamp 70 while combining those properties with the glare and spill out light control capabilities of shields 22, 24, and 42. As previously stated, appropriate configuration and positioning of arc shield 80 might eliminate the need for reflector shield 22. It is to be understood that arc shield 80 can be used singly to control light and glare, or with any combination of reflector shield 22, glare shield 24, and lamp shield 42. Each of these light controlling elements can selectively be chosen according to the specific lighting characteristics and glare or spill light problems for the lighting unit and target and surrounding areas.

Figure 14A:
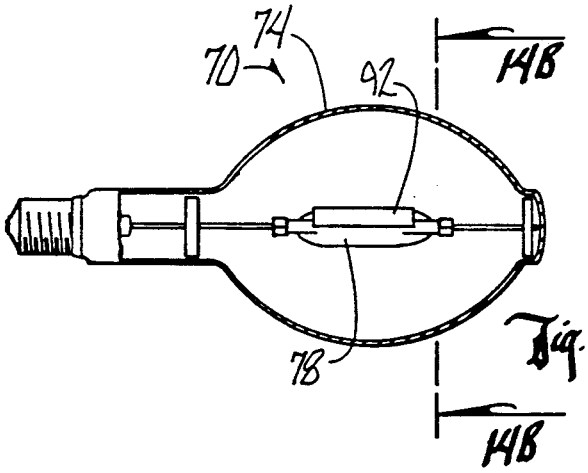
FIGS. 14A and B through 18A and B are cross-sectional elevational end views depicting various orientations and shapes of arc shields.

FIGS. 14A and B through 19A and B depict a few examples of different shapes and orientations for arc shield 80. FIGS. 14A and B show an arc shield 92 which is generally semi-circular in cross-section and is positioned on top of enlarged portion 78 of arc tube 76. It would then serve to block and redirect light downwardly.

Figure 15A:
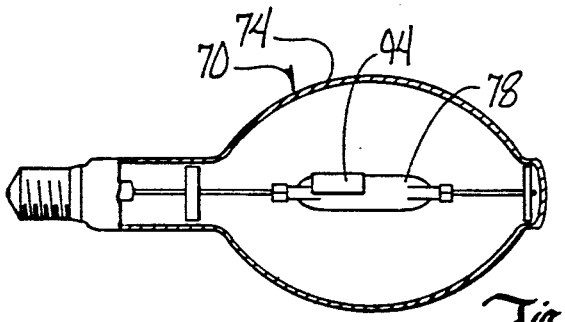
Figure 15B:
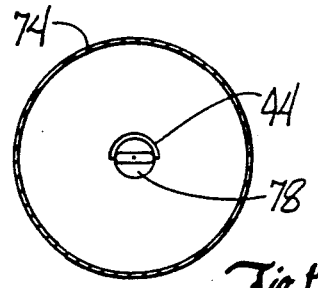

FIGS. 15A and B show an arc shield 94 which can cover only a portion of the enlarged portion 78 of arc tube 76, blocking and redirecting some of the light emanating from arc lamp 70, but not interfering with the remaining portion.

Figure 16A:
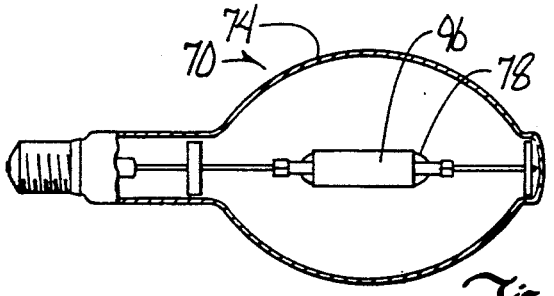
Figure 16B:
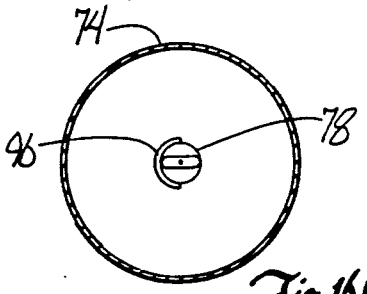

FIGS. 16A and B show an arc shield 96 which is positioned on the side of arc tube 76 to block and redirect light to the side of arc lamp 70.

Figure 14B:
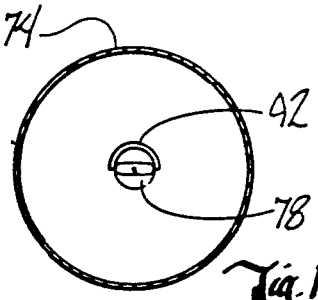
Figure 17A:
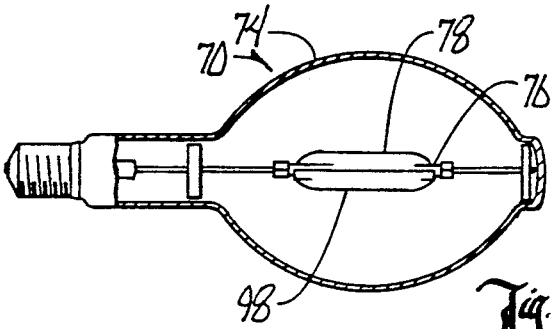
Figure 17B:
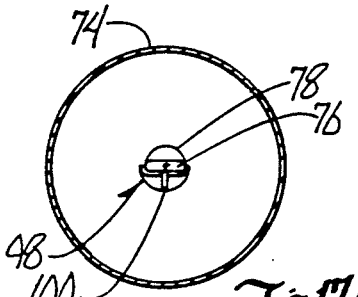

FIGS. 17A and B show an arc shield 98 which similarly to arc shield 92 of FIG. 14 covers the top of enlarged portion 78 of arc tube 76. However, arc shield 98 has an open slot 100 down its center and has front and rear ends 102 and 104 which extend a little further over the ends of enlarged portion 78. The primary purpose of arc shield 98 would be to block and redirect most of the light emanating upwardly from arc lamp 70, but allow a portion through slot 100 to pass through. A practical application of this type of arc shield would be as follows. If arc shield 98 were placed on the bottom of arc tube 76, and arc lamp 70 operatively connected to a lighting fixture such as shown in FIG. 12, and the lighting fixture was used, with a plurality of the same lighting fixtures to light an athletic field, most of the light would be allowed to emanate upwardly from arc lamp 70, be reflected by the upper hemisphere 88 of reflector 86, and directed downwardly onto the athletic field. Open slot 100, however, would allow a portion of light to go to lower hemisphere 90 and be directed upwardly and outwardly so as to give some illumination to the area above the lights and directly above the playing field. Balls or objects that were thrown or hit into this upper area would then still be sufficiently illuminated so that the players and spectators could maintain visual tracking of the object. By allowing only a little light into this upper area, glare problems could still be controlled.

Figure 18A:
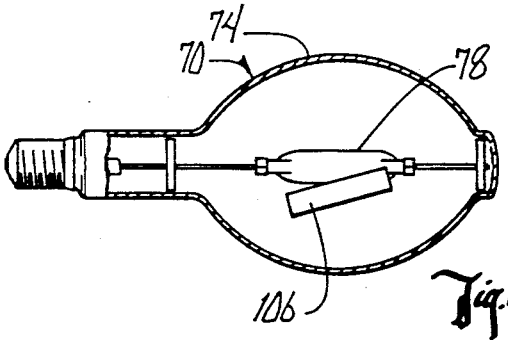
Figure 18B:
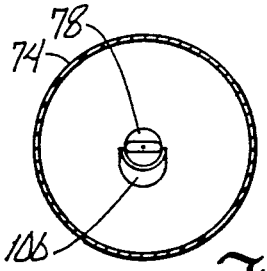

FIGS. 18A and B simply show that arc shield 106 does not necessarily need to be in abutment with arc tube 76 or in any parallel or required orientation.

Figure 19A:
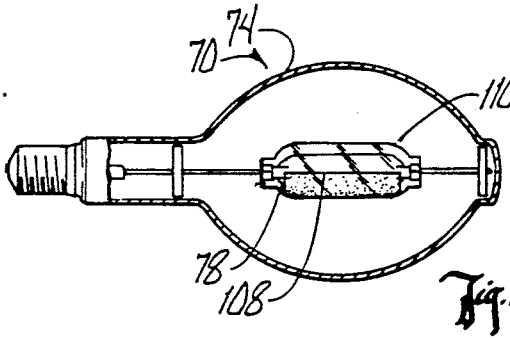
FIGS. 19A and B are side elevational and an end view of an arc tube being encapsulated by a secondary transparent tube which has an arc shield positioned on its inside surface.
Figure 19B:
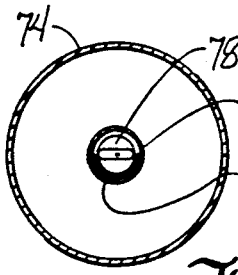

FIGS. 19A and B depict an arc shield 108, which instead of being directly adjacent to or in abutment with arc tube 76, is secured to a transparent enveloping insulating tube 110 which is secured over and around enlarged portion 78 of arc tube 76. Enveloping insulating tube 110 encloses and encapsulates arc tube 76 and at the same time positions arc shield 108 a little further away from arc tube 76 and presents some thermal insulation to reduce the chance of heat damaging or otherwise causing arc shield 108 to fail or deteriorate. It is believed that the best arc shield 108 would be a coating adhered to the inside of enveloping insulating tube 110. Other arc shields 108, are possible. It is also to be understood that it is believed the best arc shield would be one which reflects light but transmits infrared (heat) radiation. If arc shield 110 is made of aluminum or some other solid material, it is believed that enveloping insulating tube 110 would have to be as large as possible to prevent melting or damage to such a shield 110.

Figure 20:
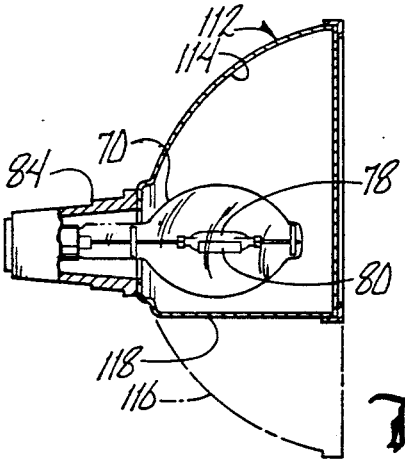
FIG. 20 is a cross-sectional elevational view of an alternative embodiment of the invention utilizing an arc shield which allows elimination of the bottom part of the symmetrical reflector as shown by ghost lines.

FIG. 20 Illustrates an alternative reflector 112, which could be utilized with arc lamp 70 utilizing arc shield 80. Because arc shield 80 blocks and redirects light which would have become incident on the lower hemisphere of a symmetrical reflector such as shown in FIG. 12, reflector 112 of FIG. 20 need only have an upper hemisphere 114. Lower hemisphere 116 is unnecessary as shown in ghost lines. A wall 118 can simply be placed between the front and rear of reflector 112 below arc lamp 70.

Figure 21:
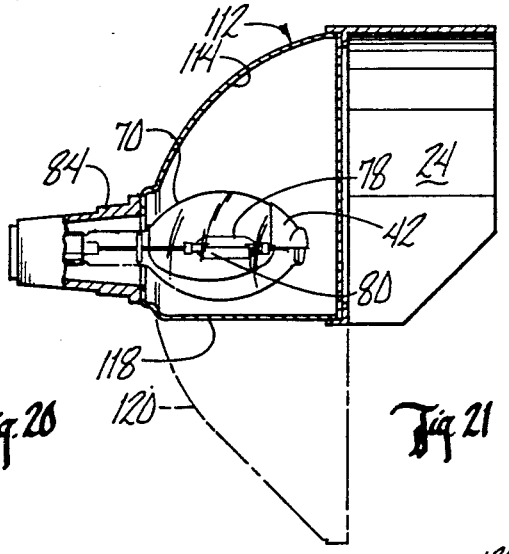
FIG. 21 is a cross-sectional elevational view of an alternative embodiment of the invention similar to FIG. 20 with attached glare shield and lamp shield, and showing in ghost lines the elimination of a lower hemisphere diverging reflector because of the arc shield.

Likewise, FIG. 21 shows the use of reflector 112 with arc lamp 70 having arc shield 80, and application of glare shield 24 and lamp shield 42. Additionally, ghost lines 120 schematically depict a lower hemisphere of reflector 112 which is made unnecessary by arc shield 80. Ghost lines 120 show that without arc shield 80, the reflecting properties of the lower hemisphere must be diverging. Thus, it would require a much longer, different, reflecting surface from the upper hemisphere. This would increase the area of reflector 112 which is generally disadvantageous because it greatly increases wind load on such a lighting fixture. Arc shield 80 with reflector 112 eliminates this problem. It also eliminates the extra structure of reflector shield 22 as used with the embodiment explained with respect to FIGS. 2 and 3.

Figure 24A:
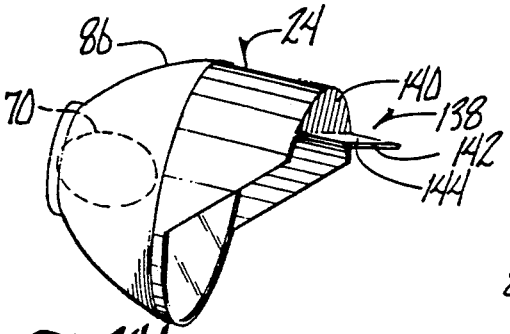
FIG. 24A is a perspective view of an alternative embodiment of the invention utilizing a glare shield and supplemental glare shield.
Figure 22:
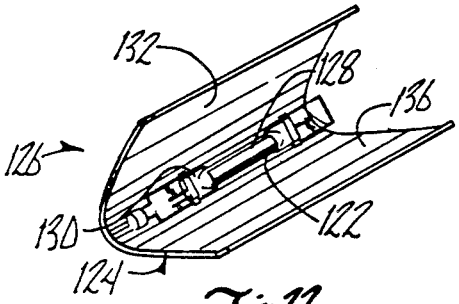
FIG. 22 is a schematic perspective view showing application of the arc shield to an asymmetrical arc lamp and reflector combination.
Figure 23:
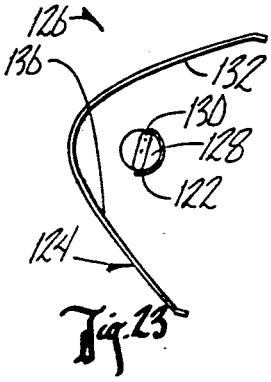
FIG. 23 is an end view of FIG. 22.
Figure 24:
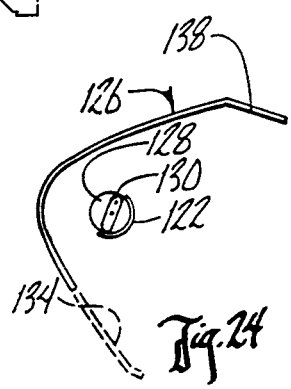
FIG. 24 is a schematic end view of an alternative embodiment of FIG. 22 showing in ghost lines an unneeded downwardly diverging lower reflector portion because of the arc shield.

FIGS. 22–24 show application of an arc shield 122 to a different arc lamp 124 used in association with an asymmetrical reflector 126. Similar results occur with respect to utilizing arc shield 122 over enlarged portion 128 of arc tube 130 where the arc for the lamp is created. Application of arc shield 122 as shown in FIGS. 22–24 would block and redirect light emanating downwardly from arc tube 130 and cause most of the light to be reflected downwardly from the upper half 132 of reflector 126 so that it can be accurately directed downwardly to a target area. FIG. 24, similarly to FIG. 21, shows in ghost lines 134 that lower one-half 136 of reflector 126 could be removed when using arc shield 122. Ghost lines 134 also show that without arc shield 122, the reflecting characteristics and shape of reflector 126 would have to be altered so that lower one half 136 would be diverging. Again, this would greatly increase the surface area of reflector 126 disadvantageously because of wind load. Redirection and control of light directly at the arc tube 130, again also reduces loss of light or dissipation which occurs when light has to travel to a larger reflective surface and then be redirected.

It can therefore be seen that utilization of an arc shield can be independently used to control light and to control glare and spill light problems. Additionally, an arc shield can eliminate or at least reduced the need to deal with light redirection problems at the bottom of the reflector, in the embodiment shown in FIGS. 20–24. Light is captured and redirected as close to the source as possible. Additionally, utilization of such features as reflector shield 22, would still result in some glare problems. Arc shields may allow elimination of this problem, and even elimination of the lower portion of the reflectors.

Use of arc shields also allows the light from the arc lamp to be captured sooner than it is generally captured on conventional reflectors. Control and efficiency of the light is increased because by capturing the light sooner, it eliminates much of the potential problems of light ending up where it is not supposed to, as can occur in the more conventional reflectors.

It is also to be understood that arc shields are easily retrofittable upon existing arc lamp fixtures. Instead of altering or removing the bottom half of the reflector, it could be painted black.

It is also understood that with proper design the arc shield has the ability to selectively redirect light through the arc tube so as to create a more uniform heating of the arc tube wall. This condition allows more of the halide compounds to remain in suspension instead of precipitating out at the cooler areas of the arc tube. This would result in more light being produced and emanated from the arc lamp further increasing its efficiency.

The arc shields can be made of many types of materials. Aluminum oxide could be used to create the arc shield as a coating on the outside of the arc tube. They may be made of stainless steel which is lined with a high temperature ceramic material. The ceramic material may be very white, which is the optimal reflective surface. Generally, the arc shield should be reflective and capable of withstanding the environmental temperature during operation of the arc lamp. It can be specular or diffuse, or any range in between, according to desire.

FIG. 24A shows an optional modification to glare shield 24 as discussed with respect to FIG. 2. A supplemental glare shield 138 can optionally be attached to the upper and outermost extending part of glare shield 24. An attachment part 140 is secured by means known within the art to the outer lip 142 of glare shield 24. An extension part 144 extends outwardly from attachment part 140 and serves to further block and/or redirectlight which may be directed upwardly and outwardly.

It is to be understood that supplemental glare shield 138 could be formed into one glare shield 24. However, in certain applications, supplemental glare shield 138 would be needed for only a few of lighting fixtures and therefore could be selectively added as needed and desired.

FIGS. 25-31 depict additional preferred alternative embodiments according to the invention. It is to be understood that these embodiments utilize some of the principles of the preceding embodiments, but also include additions, enhancements, and alternatives for providing both glare control and maximum lighting to the target area.

It is to be further understood that while most of the elements described below can be utilized individually, they also can be combined in various combinations to produce the desired glare control and maximum lighting results. The drawings depict how a number of individual elements can be mounted on conventional luminaire assembly units, but it is emphasized that these components can be removable, affixed, or integral, and can be positioned either individually or in various combinations upon a conventional luminaire assembly unit.

In particular, it is emphasized that the embodiments of FIGS. 25 to 31 are designed to achieve a high degree of glare control for each light fixture, but additionally increase the amount of usable light to the target area. In the previously described embodiments in this application, glare control can be achieved in some cases to a higher degree than the embodiments of FIGS. 25-31. However, by achieving glare control as high as 85% to 90% in those embodiments, some sacrifices with respect to the amount of light which can be directed to the target area are realized.

The embodiments of FIGS. 25 through 31 therefore depict structure and methods for allowing a high degree of glare control. But very importantly, these embodiments direct, reflect, and/or redirect light in such a manner that the amount of light is actually increased to the target area over the previously described embodiments. In fact, the amount of light to the target area is increased over conventional luminaire assembly units having no glare control features. Therefore, a satisfactory level of glare control can be achieved while actually increasing the illumination of the target area. The specific embodiments will now be described.

Figure 25:
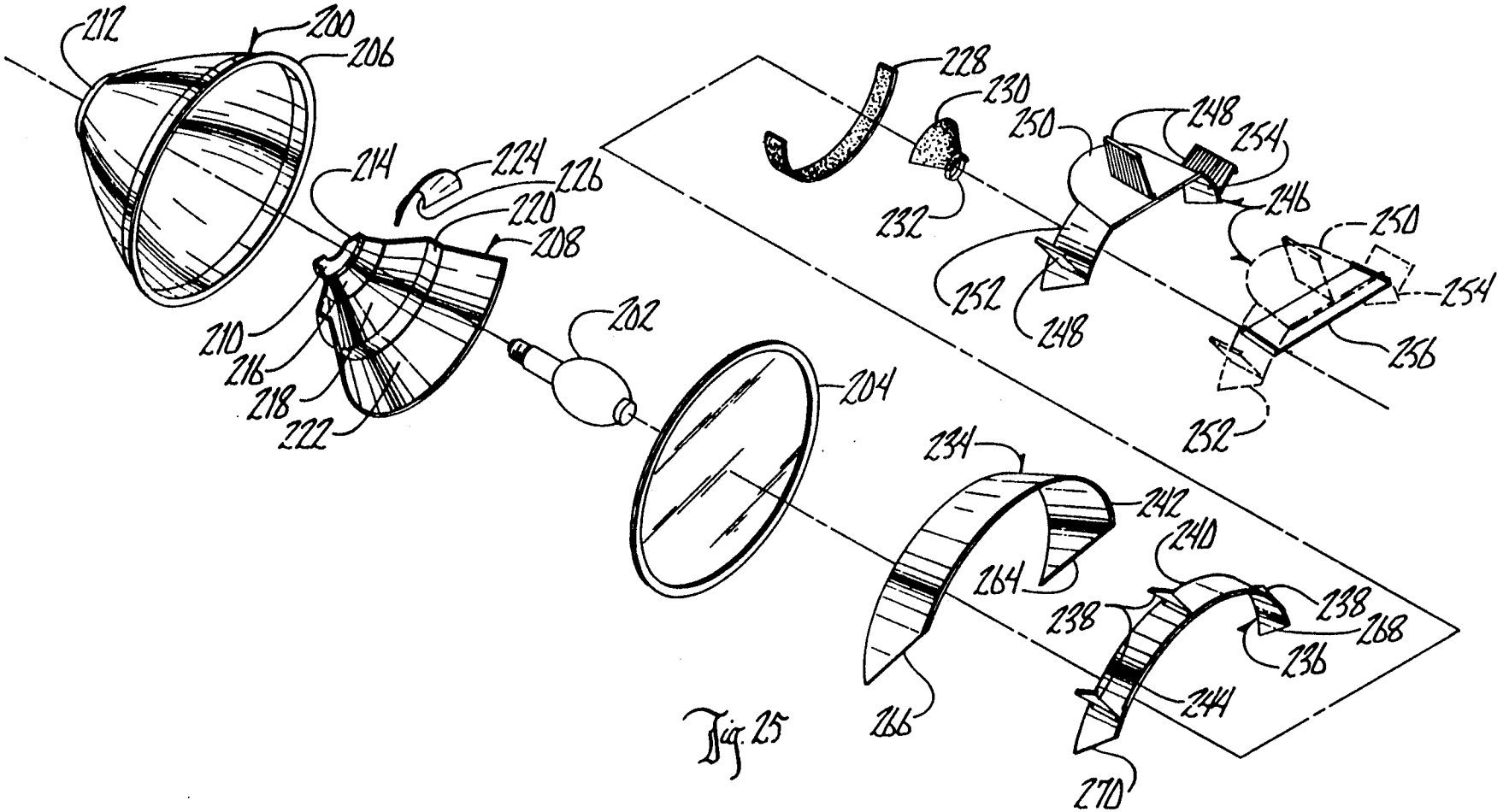
FIG. 25 is an exploded perspective view of an alternative embodiment of the invention showing various optional glare control features and additions, either individually or in sets.

By referring first to FIG. 25, an exploded perspective view of preferred embodiments of elements which can be utilized for achieving glare control with increased light to the target area are shown. A conventional symmetrical converging reflector 200 (similar to reflector 16 of FIG. 1) is shown in FIG. 25. A conventional lamp 202 is positionable in an appropriate mounting means within reflector 200, such as is known in the art, and such as has been previously described. A conventional lens assembly 204 is also shown, such as is known in the art, and is mountable on the perimeter edge 206 of reflector 200 by clips or brackets or other means known in the art.

The removable, interchangeable elements which can be utilized to achieve the glare control and increase light to the target area include a reflector insert 208 which can be mounted in the interior of reflector 200 in what will be called its lower hemisphere. It is to be understood that reflector insert 208 can take on many configurations and can be positioned at any location within reflector 200 to achieve desired light reflecting and redirecting functions, but in the preferred embodiment, as shown, in generally positioned in the lower or bottom half of reflector 200, called the lower hemisphere.

Reflector insert 208 functions similarly to reflector shield 22 of the embodiment of FIG. 1. It serves to alter the reflecting characteristics of the lower hemisphere of reflector 200 to divergingly reflect and redirect light to the target area. Without reflector insert 208, light would convergingly be reflected from the lower hemisphere, which many times causes a substantial amount of glare, and a substantial amount of usable light does not end up in the target area.

As can be seen in FIG. 25, however, the preferred embodiment of reflector insert 208 is unique in that it is comprised of a continuous piece of stepped material. One end of reflector insert 208 consists of a semi-circular piece 210 which mounts within the mounting end 212 of a conventional reflector 200. Extending generally perpendicularly outward from semi-circular piece 210 is a small lip or strip that follows the perimeter of semi-circular piece 210. Extending from lip 214 is a downward angled portion 216 which also is curved and expands outwardly. A succeeding angled portion 218 continues and extends outwardly from angled portion 216 to a step 220. Finally, a last angled portion 222 extends generally to perimeter edge 206 of reflector 200. All of the upper surfaces of reflector insert 208 are highly reflective and serve to reflect and redirect incident light in a diverging manner. Particularly, each of the steps and angled portions are designed to coherently and in a composite fashion, reflect incident light in a desired manner.

Another element which can be utilized in the invention to assist in increasing the amount of light being directed to the target area is a base reflector 224. In the preferred embodiment of FIG. 25, base reflector 224 fits into the upper half of mounting end 212 inside of reflector 200. As can be seen, base reflector 224 is basically semi-circular and curved to reflect light as desired, but also has a small cut-out 226 to allow lamp 202 to be inserted therethrough for mounting.

It is to be understood that base reflector 224 serves to assist in reflecting and redirecting any incident light in such a manner that light to the target area is increased. Otherwise that light might be either lost, cause glare, or otherwise not be useful with respect to lighting the target area. Base reflector 224 can be mounted in reflector 200 by means known within the art, or well within the skill of those in the art.

It is also to be understood that in some uses, step 220, or other portions of reflector insert 208, might disadvantageously impact on either glare or the amount of light directed to the target area. Therefore, as can be seen in FIG. 25, a step cover 228 is optionally usable. Step cover 228 can be mounted over step 220 to alter the reflecting characteristics of step 220. For example, step cover 228 can be made of a black, minimal reflection material, or can be coated with the same, to minimize any reflection from step 220. Alternatively, step cover 228 could be made of a material which is not highly specular so as to diffuse any incident light on step 220. Other light reflecting alteration characteristics can be utilized with step cover 228. Step cover 228 or step cover 220 can also be painted, or even made or coated with a highly specular material. Any of these options can be utilized according to desired lighting characteristics.

Similarly to previous embodiments, an arc cover 230 can optionally be utilized. Arc cover 230 would be mountable by securing means 232 to the front and top portion of lamp 202 when in place in reflector 200. Arc cover 230 could be made out of different types of materials, such as minimal reflecting materials or coatings, or non-specular materials. Additionally, one or both sides of arc cover 230 could be made of high specular material, and arc cover 230 could be shaped so as to reflect and redirect light in a desired manner.

Arc cover 230, in its preferred function, would serve to reduce glare caused by light directly emanating from the upper front portion of lamp 220. It could also serve to function to redirect such light back to reflector 200 and any other elements in reflector 200 to redirect such light in a manner to increase light going to the target area.

Additional elements depicted in FIG. 25 are connected to or extend from perimeter edge 206 of conventional reflector 200. Their function is to reduce glare, but also to selectively increase the amount of light directed to the target area.

Figure 26:
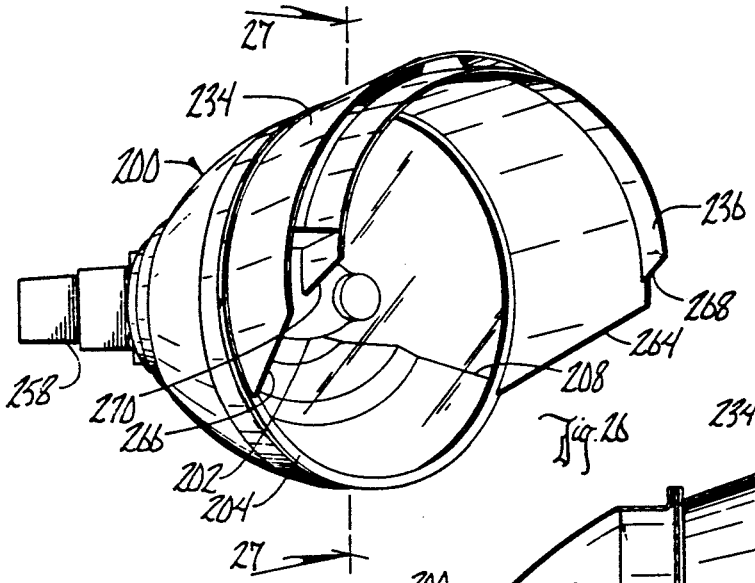
FIG. 26 is a perspective view of an alternative embodiment of the invention with certain of the glare control features of FIG. 25 added to a conventional luminaire assembly unit.

A reflector hood or visor 234 is mountable by means known within the art to the perimeter edge 206 of reflector 200. As can be seen in FIG. 26, reflector hood or visor 234 basically is positionable along the portion of perimeter edge 206 defining the upper hemisphere of reflector 200. Reflector hood 234 functions somewhat similarly to glare shield 24 of the embodiment of FIG. 1 with respect to glare control, but differs from glare shield 24 in that it not only extends outwardly from perimeter edge 206 of reflector 200, but also is angularly oriented upwardly so as to have reflecting and redirecting properties to increase the amount of light directed to the target area.

A middle hood or visor insert 236 is removably mountable to reflector hood or visor 234 by means of brackets 238. Middle visor insert 236 is basically a curved piece, in FIG. 25 is of smaller front-to-back width than visor 234, and can be angularly oriented with respect to visor 234 and/or reflector 200 to achieve desired glare control and increased light to target area functions. It is to be understood that rear edge 240 of middle visor insert 236 is generally overlapped by but approximately under front edge 242 of reflector visor 234, and middle visor insert 236 extends outwardly so that its front edge 244 functions as an extension to reflector visor 234.

Still further, an inner hood or visor insert 246 is removably mountable within middle visor insert 236 by means of brackets 248. Inner visor insert 246 would be positioned basically concentrically within middle visor insert 236. It would function to further control glare or direct increased light to the target area.

As can be seen in FIG. 25, inner visor insert 246 is comprised of a larger center portion 250 and smaller side portions 252 and 254. Center portion 250 can be angularly oriented so as to have different reflecting properties than side portions 252 and 254, or can be coordinated with side portions 252 and 254 to have similar reflecting properties.

Additionally, an arc suppressor insert 256 comprising basically a flat rectangular piece, can be removably positioned within inner visor insert 246 as shown in FIG. 25. Arc suppressor insert 256 can be positioned so that when the entire light fixture is aimed at a target location, arc suppressor insert 256 will block direct eye contact with the arc of lamp 202, which produces perceived glare. Arc suppressor insert 256 is used primarily when arc cover 230 is not utilized.

It can therefore be seen that a number of different options are available for accomplishing both the function of controlling glare, and the function of increasing the amount of light to the target area.

FIGS. 26–31 show the above described elements assembled onto reflector 200 in various configurations. It is to be understood that these figures show preferred combinations of the elements, but that the elements can individually be used for a specific desired lighting effect.

Figure 27:
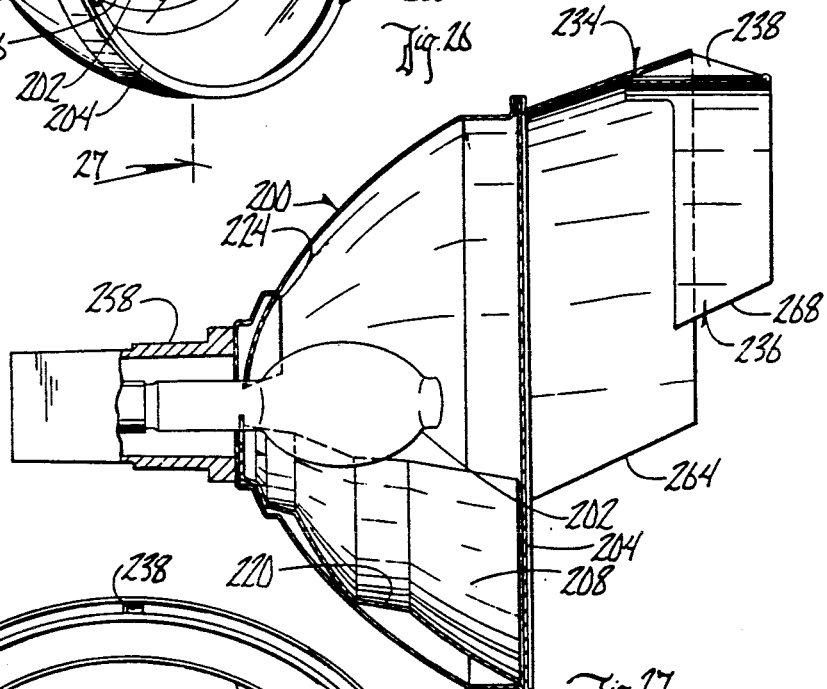
FIG. 27 is a side elevational cross-sectional view taken along lines 27—27 of FIG. 26.
Figure 28:
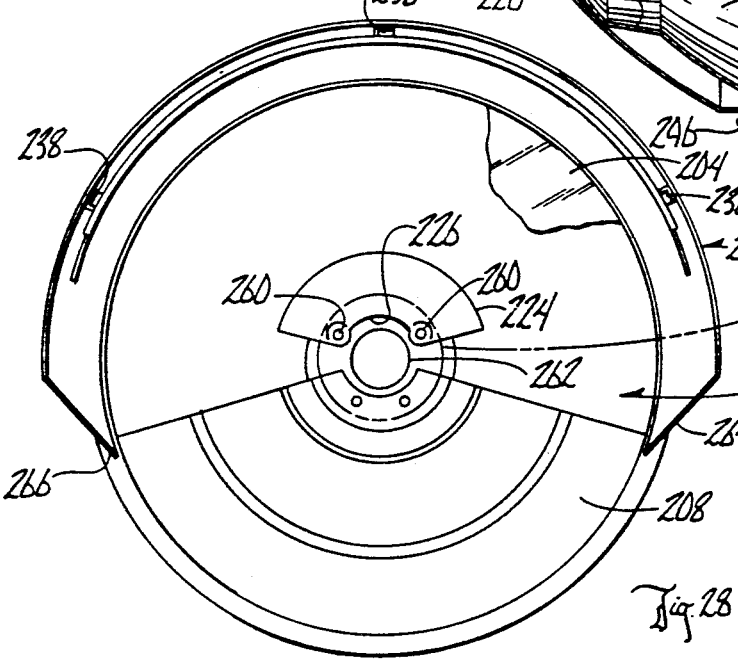
FIG. 28 is a front elevational view of the embodiment of FIG. 26.

FIGS. 26–28 show one preferred combination of glare control and increased light to the target area functions. The lamp base, socket, or bulb cone 258 is shown with reflector 200 attached to it, and arc lamp 202 mounted in bulb cone 258. Reflector insert 208 is positioned in the lower hemisphere of reflector 200. Additionally, reflector visor 234 is secured to the perimeter edge 206 of reflector 200 around the upper hemisphere of reflector 200. Middle visor insert 236 is attached by brackets 238 to reflector visor 234 and extends outwardly therefrom. Finally, base reflector 224 (see FIGS. 27 and 28) is attached through apertures 260 to reflector 200 directly above center aperture 262 of reflector 200, which allows passage of lamp 202 into bulb cone 258.

The cross-sectional view of FIG. 27 perhaps best depicts the operation of each of reflector insert 208, base reflector 224, reflector visor 234 and middle visor insert 236. Stepped reflector insert 208 converts the lower hemisphere of reflector 200 into a diverging reflector. Therefore, incident light from lamp 202 is reflected and redirected outwardly and downwardly through lens 204 to the target area. Conventional converging upper hemisphere of reflector 200 likewise reflects and directs instant light downwardly towards the target area. Reflector insert 208 operates to efficiently, and to a maximum extent, redirect light to the target area, while sending a minimum of light to areas outside the target area. Reflector insert 208 extends all the way from the center aperture 262 of reflector 200 to the perimeter edge 206 of reflector 200. FIG. 28 shows that in the preferred embodiment, reflector insert 208 does not quite cover the entire lower hemisphere of reflector 200, but a substantial part of it.

Base reflector 224 operates to basically smooth out portions of reflector 200 near center aperture 262 and redirect any incident light in a converging manner towards the target area. This assists also in eliminating glare. Base reflector 224 accomplishes the object of this preferred embodiment to not only control glare but to get the maximum amount of light to the target area as possible.

Reflector visor 234 operates to block incident light from lamp 202, and incident stray light from reflector 200, and reflect and redirect such light towards the target area. Therefore, as can be seen in FIG. 27, reflector visor 234 is angled outwardly and upwardly to create an appropriate reflecting surface towards the target area for the incident light which otherwise would be lost or become a glare problem. Reflector visor 234 extends generally around the perimeter edge 206 of reflector 200 defining the upper hemisphere of reflector 200, but has angled bottom edges 264 and 266 which can extend below the transverse dividing line between upper and lower hemispheres of reflector 200.

It is also to be understood that the components can be arranged so that light from the arc is bounced, reflected or directed from step 220 (having a reflective surface) back to reflector 200, visor 234, or middle visor insert 236 to the target area. The same can be done with top step 216 on base reflector 224.

FIG. 27 also shows the angular orientation of middle visor insert 236 with respect to reflector visor 234. Middle visor insert 236 extends outwardly from reflector visor 234 at a different cross-sectional angular orientation (approximately 20° in the preferred embodiment). Middle visor insert 236 essentially is somewhat of an extension of reflector visor 234 and blocks and redirects a certain portion of incident light from lamp 202 and reflector 200 down to the target area to both eliminate glare and to increase the amount of light to the target area. It can be seen that the preferred embodiment of middle visor insert 236 extends generally substantially the same distance around the reflector visor 234 but has angled lower end edges 268 and 270 which do not extend downwardly as far as edges 264 and 266 of reflector visor 234.

It can therefore be seen that any of the elements added to reflector 200 assist in performing glare control and providing increased light to the target area. Their full combination as shown in FIGS. 26–28 collectively achieve one possible glare control and increased light combination. It is always to be remembered, however, that specific lighting control applications can alter the required additions to reflector 200 to achieve the desired lighting results.

Figure 29:
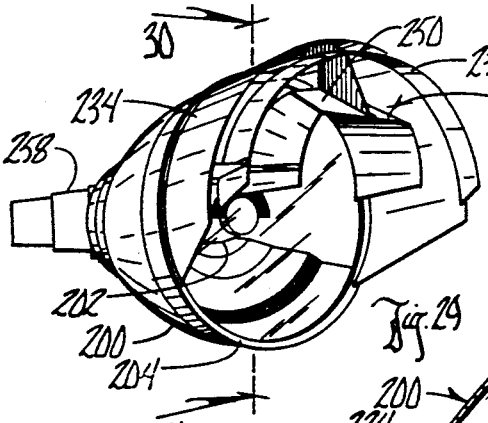
FIG. 29 is a perspective view of another embodiment according to the present invention utilizing a combination of glare control features from FIG. 25 different than that of the embodiment of FIG. 26.
Figure 30:
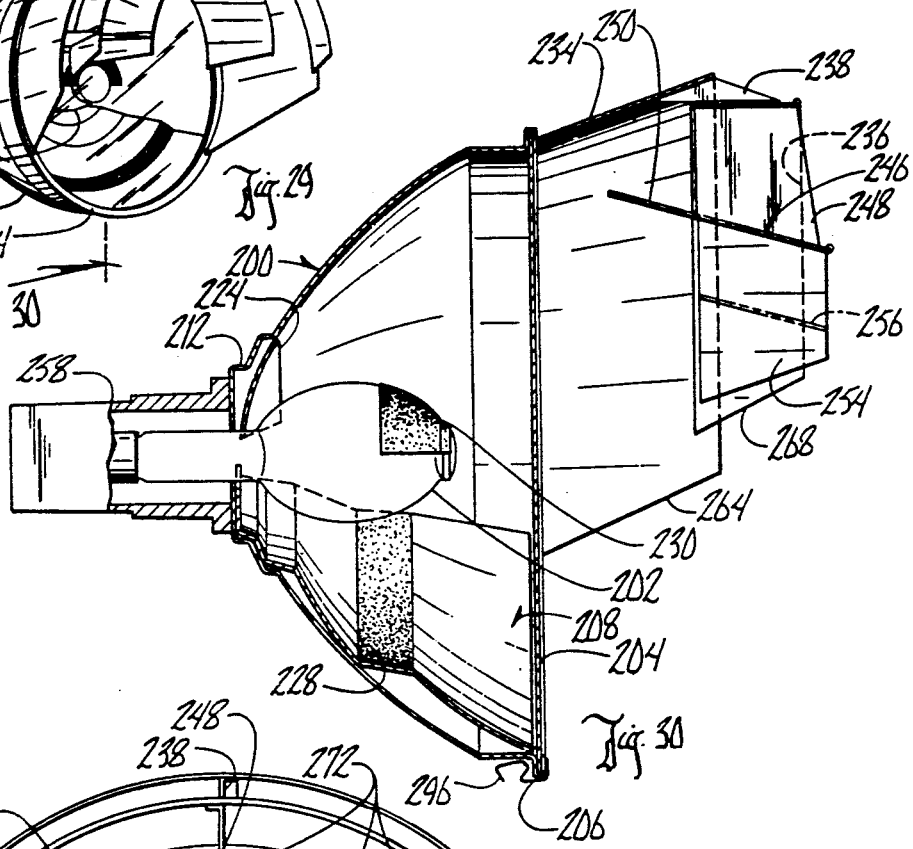
FIG. 30 is a side elevational cross-sectional view taken along lines 30—30 of FIG. 29.
Figure 31:
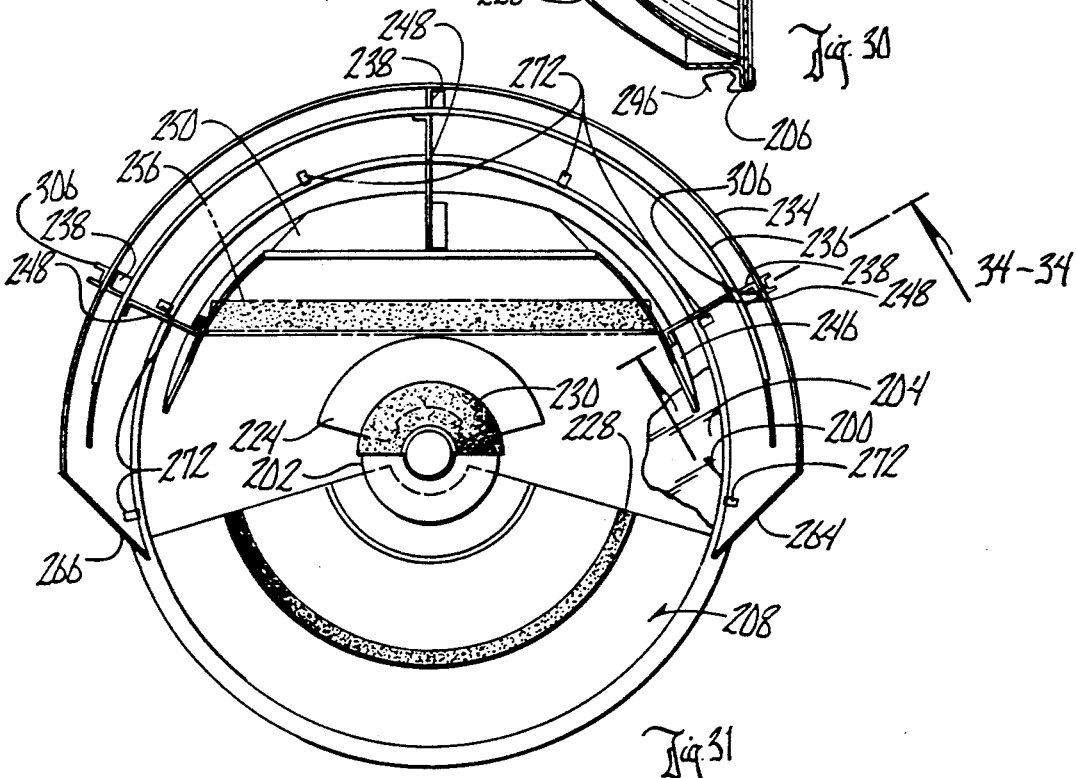
FIG. 31 is a front elevational view of the embodiment of FIG. 29.
Figure 32:
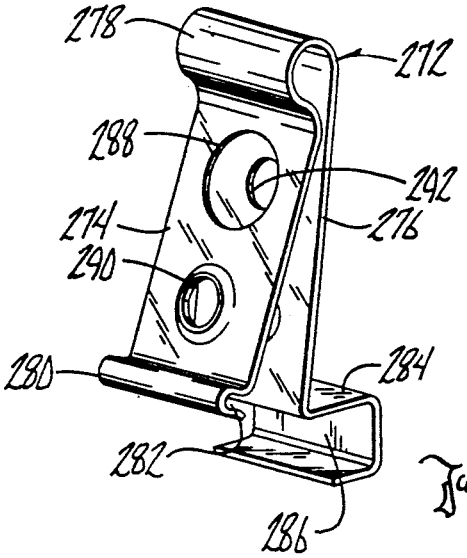
FIG. 32 is a perspective view of a clamping device utilized in removably attaching certain glare control elements in FIG. 25 to the removable lens structure of a luminaire assembly unit.
Figure 33:
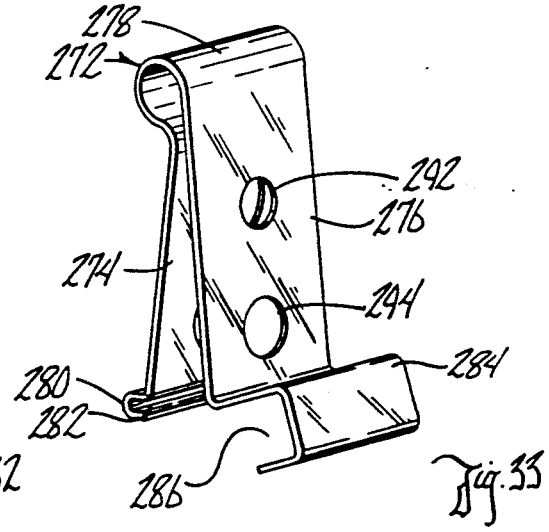
FIG. 33 is a reverse perspective view of the items shown in FIG. 32.

In comparison, FIGS. 29–31 show another preferred embodiment of the invention. In this embodiment, reflector insert 208 is utilized along with reflector visor 234 and middle visor insert 236. These elements function as previously described. Additionally step cover 228 is utilized and in this preferred embodiment is made out of a minimally reflecting material to minimize any glare problems created by step 220 of reflector insert 208.

Also, inner visor insert 246 is utilized, and as can be seen, especially in FIG. 30, extends from basically the inner middle of reflector visor 234 outwardly to a position somewhat outward of middle visor insert 236. Center portion 250 of inner visor insert 246 functions to directly affect light to a specific degree. Its major purpose is to reflect and redirect light to the target area and prevent light from traveling outside the target area. Side portions 252 and 254 can also assist in this function.

Finally, the embodiment of FIGS. 29–31 can optionally and alternatively utilize either arc cover 230, which in the preferred embodiment is also made of a minimally reflecting material, or when arc cover 230 is not utilized, arc suppressor insert 256 can be mounted within inner visor insert 246. Arc suppressor insert 256 functions not only to block the glare directly emanating from lamp 202 by being positioned to block direct view of at least a portion of lamp 202, but also is reflective and can operate to reflect and redirect light to the target area. If desired, the top of the suppressor insert could be painted black or otherwise be made non-reflective.

It will be appreciated that the present invention can take many forms and embodiments. The true essence and spirit of this invention are defined in the appended claims, and it is not intended that the embodiments of the invention presented herein should limit the scope thereof.

For example, the reflector insert, base reflector, reflector visor, middle visor insert, inner visor insert, and arc suppressor insert, all can have various means of connection to their respective parts. Additionally, each of these elements can be finished, coated, or otherwise function with different reflective surfaces. For example, some of the parts can have bright, specular surfaces, where others can have dull, nonspecular surfaces. Ranges of specularity can also be utilized between parts depending on results desired. Thus, the reflective surfaces can range anywhere between a bright finish and a dull finish.

It is also to be understood that while the preferred embodiments show the elements being retrofitted onto a conventional reflector arc lamp luminaire assembly unit, the invention also pertains to originally manufactured luminaire assembly units having these elements integrated therewith. For example, reflector 200 could be originally manufactured to contain the converging upper hemisphere with the diverging lower hemisphere, instead of the reflector insert 208. It could be accomplished by stamping the lower hemisphere in a manner to make it diverging. Reflectors could also be made or have the surface formed to desire by secondary stamping, spinning, etching, or other methods. On the other hand, each of the elements which are retrofittable to conventional reflectors can be configured so that they are easily removable, securable, and adjustable.

Production of the particular embodiment for a particular lighting and/or glare control situation can therefore be accomplished in a number of different ways. The major reflector can be originally produced to operate in the desired manner, or can be altered to achieve the same. Still further, parts can be retrofitted to it for the same purpose. Depending on desire, visors, and means to alter the reflecting properties of the reflector can be designed and originally manufactured into an embodiment. The lower hemisphere of the reflector can be originally manufactured to have reflecting properties different from the upper hemisphere. As previously stated, the lower hemisphere could be diverging as opposed to a converging upper hemisphere. Still further, the lower hemisphere could have different stages or portions having different reflecting characteristics. For example, one portion could be diverging whereas another portion could be converging.

Similar characteristics can, of course, be accomplished by add-on pieces, as previously described. Additionally, however, the surfaces of the reflecting pieces can be altered to produce various reflecting characteristics. Again, this can be originally manufactured into the surfaces, or can be produced by add-on pieces or coatings.

It is further more important to understand that not all of the methods or elements to manipulate light emanating from the luminaire assembly unit need to be used for each different lighting application. There are lighting needs, problems, and considerations that are unique for each application; therefore you need consideration and implementation. The invention therefore allows such customized and flexible implementation.

Specific examples include utilization of such systems for sports lighting. The invention can significantly reduce any glare problems, either for players, spectators, or for surrounding areas (if outdoor lighting), while maintaining, and even enhancing, the playability of the field or area. While enabling the ability to have abrupt light cutoff, without reducing light levels, specific luminaire assembly units which have glare control problems can be remedied. If this requires application of various methods and apparatus discussed previously to all luminaire assembly units, or only a few, the invention can accomplish the same. The embodiments can even operate to increase useful light to target area.

Other applications outside of the sports lighting area also benefit from the present invention. Still further, the invention can be utilized either on original equipment, or retrofitted to existing equipment.

Furthermore, the exact reflecting properties of these elements can be determined by prearranged premanufacturing specifications according to desired reflecting results. The angular diverging reflection of reflector insert 208 can be altered by altering the curvature and angle of angled portions 216, 218 and 222. Additionally, portions of reflector insert 208 could be made to be diverging, whereas only portions could be made converging, if desired, for a specific lighting and glare control application. Likewise, the angle of reflector visor 234 can be adjusted along with the angular attitude of middle visor insert 236, inner visor insert 246, and arc suppressor insert 256. Base reflector 224 can also be manufactured to desired reflecting shape.

In the preferred embodiment, the angle of center portion 250 of inner visor insert 246 is 17.5° from the center axis of reflector 200.

Another aspect of the invention involves the manner in which the reflector visor 234 is mounted to the light fixture. As can be seen in FIG. 31, one method is to utilize a plurality of clips 272 at spaced apart locations between reflector visor 234 and the fixture. Clips 272 must be made of a material, and configured so that reflector visor 234, and all structure mounted to reflector visor 234, are securely held in place, and can withstand environmental forces such as wind, rain, etc. Additionally, clips 272 are preferred to be easy to install, and allow easy disassembly and maintenance for the light fixture. Also, it is preferred that the clips be economical to manufacture, and efficient and durable.

FIGS. 32–35 depict a preferred embodiment for clip 272. Clip 272 comprises a first leg 274 which is joined to a second leg 276 by a loop portion 278. Loop portion 278 basically causes legs 274 and 276 to be normally spread apart at their outer ends, and provides resilient, spring-like action to legs 274 and 276. Each outward end of first and second legs 274 and 276 contains a generally C-shaped-in-cross-section foot. Small, rounded C-shaped foot 280 of first leg 274 has a rounded channel 282 transversely across it. Similarly, larger C-shaped foot 284 of second leg 276 has a larger rectangularly shaped channel 286 extending transversely along it. The open sides of both channels 284 and 286 face each other.

First leg 274 also has large aperture 288, and a threaded aperture 290. Second leg 276 has an aperture 292 which is aligned with and generally coaxial with large aperture 288 of first leg 274. Second aperture 294 is generally aligned with and coaxial with threaded aperture 290 of first leg 274.

Figure 34:
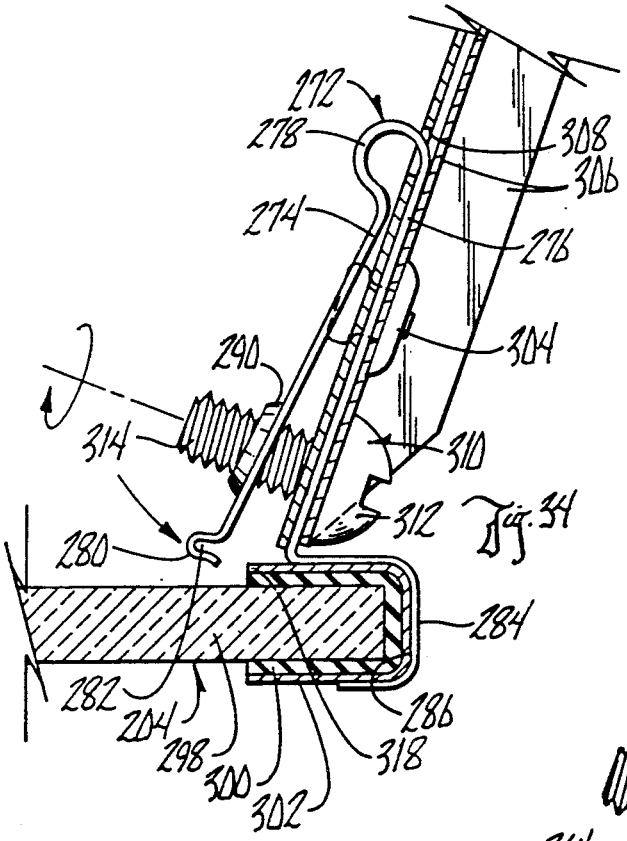
FIG. 34 is a sectional view taken along lines 34—34 of FIG. 31, but showing the item of FIGS. 32 and 33 in position on the lens structure, but not fully secured thereto.
Figure 35:
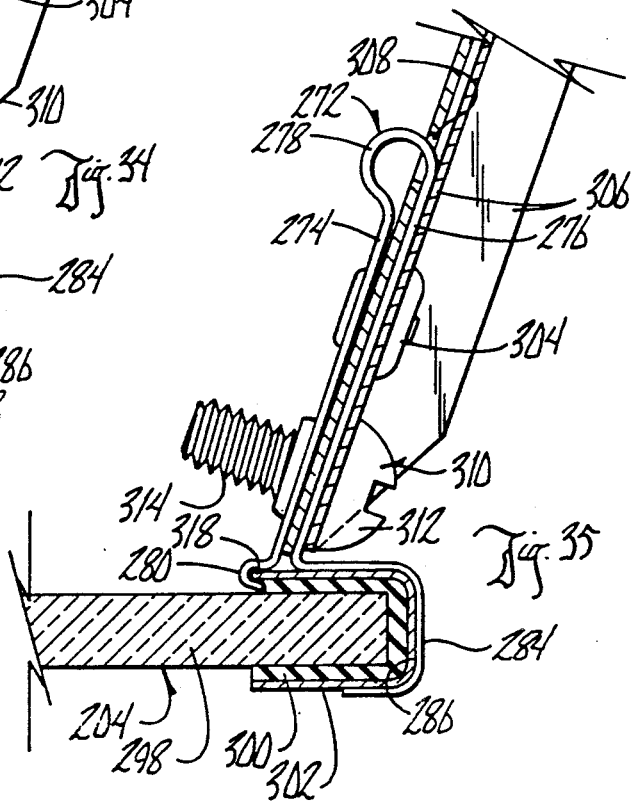
FIG. 35 is a sectional view taken along lines 34—34 of FIG. 31, essentially similar to FIG. 34 except showing the item of FIGS. 32 and 33 in a fully secured and attached position to the lens of the reflector and luminaire assembly unit.

FIGS. 34 and 35 show specifically how clips 272 are utilized to attach reflector visor 234 to the lighting fixture. It is to be understood that clips 272 attach directly to lens assembly 204 around its perimeter. Lens 204 is removably and securely connected to reflector 200 by means known within the art, such as lens brackets 296 distributed at spaced-apart locations around the perimeter of lens assembly 204 (see an example of bracket 296 in FIG. 27 and FIG. 30). By securing reflector visor 234 to lens assembly 204, access to lamp 202 can be easily accomplished by simply removing lens assembly 204. This makes maintenance, lamp replacement, and construction easy, simple, efficient, and economical.

FIGS. 34 and 35 show that lens assembly 234 includes a transparent lens 298, having its perimeter edge 206 capped by a liner member 300, and an overcap 302, which are both securely attached to lens 298 and to each other.

Clip 272 is secured to reflector visor 234 by rivet 304 which extends through an aperture in reflector visor 234. It is to be understood that in FIGS. 34 and 35, a strengthening rib 306 is shown (see also FIG. 31) riveted to clip 272 on the opposite side of first leg 274 from reflector visor 234. It is also to be understood that loop portion 278 of clip 272 extends through slot 308 in reflector visor 234 so that first leg 274 of clip 72 is positioned on an opposite side of reflector visor 234. The position of slot 308, and the aperture in reflector visor 234 is selected at spaced apart locations around the edge of reflector hood 234 which is adjacent to lens assembly 204.

FIGS. 34 and 35 also show that a screw 310 has a head 312 positioned on one side of second leg 276 of clip 272, and abuts against strengthening rib 306 (when utilized), or against one side of second leg 276 of clip 272, when rib 306 is not utilized, or if clip 272 is positioned in a location without rib 306. The threaded body 314 of screw 310 slidably extends through second aperture 294 in second leg 276 of clip 272 and into threaded engagement in threaded aperture 290 of first leg 274.

Larger C-shaped foot 284 of second leg 276 is configured to mateably cover a portion of overcap 302 of lens assembly 204. By referring to FIG. 34, when C-shaped foot 284 is in such a position, screw 310 is rotated in an appropriate direction to cause first leg 274 of clip 272 to be drawn towards second leg 276. This causes smaller C-shaped foot 280 of first leg 274 to be drawn to the position shown in FIG. 35 wherein edge 318 of overcap 302 extends into channel 282 of C-shaped foot 280. Liner member 300 is generally resilient to accept the front edge of C-shaped foot 280. The clamping action of clip 272 thus secures reflector visor 234 to lens assembly 204. By positioning clips 272 at selected positions around lens assembly 204 corresponding with reflector visor 234, the total attachment of reflector visor 234 is accomplished.

It is to be understood that large aperture 288 in first leg 274 of clip 272 is larger than the portion of the rivet which extends through it, so that first leg 274 can come into direct abutment to reflector visor 234. The resiliency and outwardly biasing force caused by loop portion 278 of clip 272 assists in insuring that screw 310 does not loosen when in the position shown in FIG. 35.

It can therefore be seen that clips 272 achieve advantageous functions efficiently and economically.

What is claimed is:

1. A method of selectively controlling light from a luminaire assembly unit which includes a lamp mounted in a reflector having a reflecting surface, for light target areas and surrounding environment having different glare, spill light, and lighting halo problems, while at the same time still permitting effective utilization of said luminaire assembly unit for the production of maximum uniform, quality, composite, wide scale lighting of the selected light target area comprising:

determining the precise lighting requirements and glare problems including, but not limited to, glare, lighting halo, and lighting spill of a particular light target area;

determining the desired lighting characteristic of each luminaire assembly so that the lighting for the target area will reduce the precise glare problems by selectively and compositely reducing at least one of glare, lighting halo, and lighting spill, while still directing, reflecting, and redirecting increased amounts of usable light to said target area; and adapting the lamp and reflector lighting and reflecting properties of each luminaire assembly unit to produce lighting with the desired lighting characteristics but without undesired significant upwardly directed stray light, glare, or light spill by selectively incorporating, as needed, a reflector visor to extend from the perimeter of said reflector, and selectively altering a portion of the reflecting surface of said reflector.

2. The method of claim 1 wherein the reflector is altered by incorporating an independent member onto the reflector.

3. The method of claim 1 wherein the reflector is altered by producing the shape of the reflector to have a portion of the reflector surface with different reflecting properties than other portions.

4. The method of claim 3 wherein the reflector is altered by changing its reflecting characteristics, at least on a portion of the reflector.

5. The method of claim 4 wherein the reflector has an upper hemisphere and a lower hemisphere, and the lower hemisphere lighting characteristics are changed.

6. The method of claim 5 wherein the light reflecting characteristics of the lower hemisphere are changed to cause the lower hemisphere to divergingly reflect incident light so that incident light does not pass through a plane defining the boundaries between the upper and lower hemisphere.

7. The method of claim 1 wherein changing the lamp and reflector lighting and reflecting properties further comprises selectively incorporating, as needed, a second reflector visor extending from the reflector visor.

8. The method of claim 1 further comprising the step of incorporating an arc cover to the lamp.

9. The method of claim 1 further comprising utilizing one or more reflector altering means on the reflector.

10. The method of claim 1 wherein additions to the reflector and lamp are configured and oriented so as to direct a maximum amount of light to the target area, control glare, and redirect light to the target area.

11. The method of claim 1 wherein the reflector is altered by producing a reflecting surface having varying light reflecting characteristics.

12. The method of claim 1 wherein the reflector is altered by producing the shape of the reflector to have at least one portion of the reflector surface having converging reflecting properties, and another portion of the reflector surface having diverging reflecting properties, in correspondence to a particular lamp placement with respect to the reflector.

13. A method for producing maximum, non-glare lighting of desired and sufficient intensity, quality, and uniformity in and throughout a target space while selectively controlling, diminishing, or eliminating glare, spill light, and any dome or halo effect outside of the target space, said lighting being produced by a luminaire assembly unit comprised of a lamp mounted in a reflector, comprising the steps of:

determining the light producing characteristics of the luminaire assembly unit;

determining the sufficient intensity and uniformity of light desired for the target space;

determining the glare, spill light and dome or halo effect problems, if any, for desired lighting of the target space;

producing the desired lighting while at the same time controlling, diminishing, or eliminating selected lighting problems by selectively utilizing one or more light controlling steps comprising:

positioning a reflector visor extending from the perimeter of the reflector; and altering the reflecting properties of at least a portion of the reflecting surface of the reflector.

14. A glare control lighting fixture for maximum, non-glare lighting of a light target area, comprising:

a conventional luminaire assembly unit, having a reflector with a perimeter edge, and a lamp mounted in said reflector, for providing controlled light to the light target area and including at least one of the following to control, diminish or eliminate selected lighting problems including, but not limited to, glare, spill light, or halo effect;

a reflector visor removably positioned on said reflector perimeter edge and extending outwardly from the top of said reflector to block, redirect and reflect incident light of said lamp and reflector to the target area; and a diverging reflector insert removable positioned in said reflector below said lamp to cause incident light from said lamp and reflector to be directed to the target area and to prevent incident light from being reflected outside the target area.

15. The device of claim 12 wherein the reflector visor is positioned around generally the upper hemisphere of the reflector.

16. A glare control lighting fixture for producing maximum, nonglare lighting of a light target area, comprising:

a luminaire assembly unit, having a converging reflector with a perimeter edge and a lamp mounted on said reflector, for providing controlled light to a target area; the luminaire assembly unit having at least one of the following to control, diminish, or eliminate selected lighting problems, including, but not limited to, glare, spill light, or halo effects;

a reflector visor removably positioned on said reflector perimeter edge and extending outwardly from the reflector to block and reflect incident light of said lamp and reflector to the target area; and a diverging reflector insert removably positioned in said symmetrical reflector below said lamp to cause incident light from said lamp and reflector to be directed divergingly to the target area and to prevent incident light from being reflected outside the target area.

17. The device of claim 20 wherein the diverging reflector insert is generally positioned in the lower hemisphere of the reflector.

18. The device of claim 17 wherein the diverging reflector insert comprises a continuous curved piece generally conforming to the curved surface of the lower hemisphere of the reflector, but having stepped portions extending from the center of the reflector to its perimeter edge, each stepped portion having diverging reflecting properties.

19. The device of claim 16 further comprising a second reflector insert generally positionable at the center of the reflector near the location where the lamp is mounted in the reflector to reflect and redirect incident light in a manner to increase light to the target area.

20. The device of claim 16 further comprising an arc cover over a portion of the lamp to reduce glare by blocking direct vision of the lamp.

* * * * *

Disclaimer 5,075,828—Myron K. Gordin; Jim L. Drost, both of Oskaloosa, Iowa. GLARE CONTROL LAMP AND REFLECTOR ASSEMBLY AND METHOD FOR GLARE CONTROL. Patent dated Dec. 24, 1991. Disclaimer filed Nov. 12, 1997, by the assignee, Musco Corp.

Hereby enters this disclaimer to claims 1, 3-5, 11 and 13 of said patent.

*(Official Gazette,* January 13, 1998)